US011458356B2

(12) United States Patent
Lu et al.

(10) Patent No.: US 11,458,356 B2
(45) Date of Patent: Oct. 4, 2022

(54) SYSTEMS AND METHODS FOR ADJUSTING A STIFFNESS OF FITNESS MACHINES

(71) Applicant: Life Fitness, LLC, Rosemont, IL (US)

(72) Inventors: Zhi Lu, Glenview, IL (US); Peter Kanakaris, Arlington Heights, IL (US)

(73) Assignee: Life Fitness, LLC, Rosemont, IL (US)

( * ) Notice: Subject to any disclaimer, the term of this patent is extended or adjusted under 35 U.S.C. 154(b) by 10 days.

(21) Appl. No.: 17/167,184

(22) Filed: Feb. 4, 2021

(65) Prior Publication Data

US 2021/0252334 A1 Aug. 19, 2021

Related U.S. Application Data

(60) Provisional application No. 62/976,871, filed on Feb. 14, 2020.

(51) Int. Cl.
*A63B 22/02* (2006.01)
*A63B 71/00* (2006.01)

(52) U.S. Cl.
CPC ..... *A63B 22/0228* (2015.10); *A63B 22/0214* (2015.10); *A63B 2071/0063* (2013.01); *A63B 2225/093* (2013.01)

(58) Field of Classification Search
CPC ..... A63B 22/0207–0228
See application file for complete search history.

(56) References Cited

U.S. PATENT DOCUMENTS 5,279,528 A 1/1994 Dalebout et al.
5,336,144 A * 8/1994 Rodden ..... A63B 22/02 482/54
5,382,207 A 1/1995 Skowronski et al.
5,827,155 A 10/1998 Jensen et al.
5,993,358 A 11/1999 Gureghian et al.
6,013,011 A 1/2000 Moore et al.
6,053,848 A 4/2000 Eschenbach
6,174,267 B1 1/2001 Dalebout et al.
(Continued)

FOREIGN PATENT DOCUMENTS

CN 1919380 A 2/2007
CN 201052372 Y 4/2008
(Continued)

OTHER PUBLICATIONS

European Search Report for corresponding European Application No. 21156302.8 dated Jul. 21, 2021.

*Primary Examiner* — Nyca T Nguyen
(74) *Attorney, Agent, or Firm* — Andrus Intellectual Property Law, LLP

(57) ABSTRACT

A fitness machine providing shock absorption for a user operating the fitness machine. The fitness machine includes a base and a mobile portion engageable by the user and moveable relative to the base during operation of the fitness machine. A resilient body resists movement of the mobile portion towards the base in a height direction, where the resilient body has first and second ends defining a length therebetween, and where the length is defined in a length direction that is perpendicular to the height direction. A stop wall is engageable by the resilient body, where the length of the resilient body increases when the mobile portion moves towards the base until the second end engages with the stop wall. The resilient body provides shock absorption for the user.

20 Claims, 10 Drawing Sheets

(56) References Cited

U.S. PATENT DOCUMENTS

| | | | | |
|---|---|---|---|---|
| 6,174,268 | B1 | 1/2001 | Novak | |
| 6,280,362 | B1 | 8/2001 | Dalebout et al. | |
| 6,328,676 | B1 | 12/2001 | Alessandri | |
| 6,394,239 | B1 | 5/2002 | Carlson | |
| 6,436,008 | B1 | 8/2002 | Skowronski et al. | |
| 6,572,512 | B2 | 6/2003 | Anderson et al. | |
| 6,572,513 | B1 | 6/2003 | Whan-Tong | |
| 6,623,407 | B2 | 9/2003 | Novak et al. | |
| 6,652,424 | B2 | 11/2003 | Dalebout | |
| 6,738,482 | B1 | 5/2004 | Jaber | |
| 6,821,230 | B2 | 11/2004 | Dalebout et al. | |
| 6,893,383 | B1 | 5/2005 | Chang et al. | |
| 6,923,746 | B1 | 8/2005 | Skowroski et al. | |
| 6,945,913 | B2 | 9/2005 | Moore et al. | |
| 7,001,312 | B2 | 2/2006 | Alessandri et al. | |
| 7,077,788 | B2 | 7/2006 | Chang | |
| 7,163,493 | B1 | 1/2007 | Kuo | |
| 7,563,203 | B2 | 7/2009 | Dalebout et al. | |
| 7,563,205 | B2 | 7/2009 | Alling | |
| 7,628,733 | B2 | 12/2009 | Donner et al. | |
| 7,976,437 | B1 | 7/2011 | Detten | |
| 8,012,068 | B1 | 9/2011 | Malcolm | |
| 8,118,888 | B2 | 2/2012 | Molter et al. | |
| 8,157,708 | B2 | 4/2012 | Daly et al. | |
| 8,454,480 | B2 | 6/2013 | Molter et al. | |
| 9,352,186 | B2 | 5/2016 | Watterson | |
| 9,814,929 | B2 | 11/2017 | Moser | |
| 10,589,146 | B2 | 3/2020 | Becker et al. | |
| 2003/0139261 | A1 | 7/2003 | Kuo | |
| 2004/0138030 | A1 | 7/2004 | Wang et al. | |
| 2004/0147372 | A1 | 7/2004 | Wang et al. | |
| 2005/0164839 | A1 | 7/2005 | Watterson et al. | |
| 2006/0287163 | A1 | 12/2006 | Wang | |
| 2007/0015635 | A1* | 1/2007 | Donner | A63B 22/0228 482/54 |
| 2007/0015636 | A1* | 1/2007 | Molter | A63B 22/02 482/54 |
| 2007/0225127 | A1 | 9/2007 | Pan et al. | |
| 2008/0171640 | A1 | 7/2008 | Chang | |
| 2008/0176718 | A1 | 7/2008 | Wang | |
| 2008/0312047 | A1 | 12/2008 | Feng | |
| 2008/0318737 | A1 | 12/2008 | Chu | |
| 2009/0181829 | A1* | 7/2009 | Wu | A63B 22/02 482/54 |
| 2012/0129654 | A1 | 5/2012 | Wang | |
| 2012/0178590 | A1 | 7/2012 | Lu | |
| 2012/0270704 | A1* | 10/2012 | Wang | A63B 22/0214 482/54 |
| 2013/0053222 | A1* | 2/2013 | Lo | A63B 22/02 482/54 |
| 2013/0130868 | A1 | 5/2013 | Hou et al. | |
| 2013/0274071 | A1 | 10/2013 | Wang | |
| 2016/0287930 | A1 | 10/2016 | Moser | |
| 2018/0043207 | A1 | 2/2018 | Moser | |
| 2020/0188728 | A1* | 6/2020 | Ma | A63B 22/0207 |

FOREIGN PATENT DOCUMENTS

| | | | |
|---|---|---|---|
| CN | 101310798 | A | 11/2008 |
| CN | 101468246 | A | 7/2009 |
| CN | 201949549 | U | 8/2011 |
| CN | 203060669 | U | 7/2013 |
| CN | 203564706 | U | 4/2014 |
| CN | 204233670 | U | 4/2015 |
| CN | 204261260 | U | 4/2015 |
| CN | 104623865 | A | 5/2015 |
| CN | 204563439 | U | 8/2015 |
| CN | 205198806 | U | 5/2016 |
| CN | 105797308 | A | 7/2016 |
| CN | 205516180 | U | 8/2016 |
| CN | 107456712 | B | 4/2019 |
| CN | 110393892 | A | 11/2019 |
| DE | 202006017300 | U1 | 4/2007 |
| EP | 2656881 | A1 | 10/2013 |
| KR | 200429306 | Y1 | 10/2006 |
| KR | 101221857 | B1 | 1/2013 |
| KR | 2015106131 | A | 9/2015 |
| TW | 200843813 | A | 11/2008 |
| WO | WO 2008099430 | A1 | 8/2008 |

* cited by examiner

SYSTEMS AND METHODS FOR ADJUSTING A STIFFNESS OF FITNESS MACHINES

CROSS REFERENCE TO RELATED APPLICATION

This application claims the benefit of U.S. Provisional Patent Application No. 62/976,871, filed Feb. 14, 2020, which is incorporated herein by reference in its entirety.

FIELD

The present disclosure generally relates to systems and methods for adjusting the stiffness of fitness machines.

BACKGROUND

The following U.S. patents provide background information and are incorporated herein by reference in entirety.

U.S. Pat. No. 8,118,888 discloses a method to support a deck of an exercise treadmill one or more arcuate leaf springs are used in a deck support structure. The leaf springs can be made of a single member of elastomeric material. An adjustment mechanism can be used to change the radius of the leaf springs to vary spring rates of the leaf springs. Where different leaf springs are used, the adjustment mechanism can be used to adjust the spring rates of different springs independently.

U.S. Pat. No. 5,382,207 discloses a method to improve tracking, whereby an exercise treadmill is provided with a frame including molded plastic pulleys, having an integral gear belt sprocket, an endless belt extending around the pulleys and a motor operatively connected to the rear pulley to drive the belt. The pulleys are molded out of plastic and have a diameter of approximately nine inches. A mold and method for producing large diameter treadmill pulleys having an integrally molded sprocket are also disclosed. A deck underneath the running surface of the belt is supported by resilient members. A positive lateral belt tracking mechanism is used to correct the lateral position of the belt. A belt position sensor mechanism is used in combination with a front pulley pivoting mechanism to maintain the belt in the desired lateral position on the pulleys. The exercise treadmill also includes a lift mechanism with an internally threaded sleeve engaged to vertically aligned nonrotating screws. A user display of foot impact force on the belt is also provided.

U.S. Pat. No. 7,628,733 discloses a method to provide variable resilient support for the deck of an exercise treadmill via one or more resilient members are secured to the deck and a moveable support member is used to selectively engage the resilient members to provide support for the deck. A user operated adjustment mechanism can be used to move the support member or support members longitudinally along the treadmill thus effectively changing the number of resilient support members supporting the deck.

U.S. Pat. No. 6,572,512 discloses an exercise treadmill which includes various features to enhance user operation and to reduce maintenance costs. Sound and vibration are reduced in a treadmill by mounting the treadmill belt drive motor on motor isolation mounts that include resilient members. A further feature is a double-sided waxed deck where one side of the deck is covered by a protective tape.

U.S. Pat. No. 6,783,482 discloses a microprocessor-based exercise treadmill control system which includes various features to enhance user operation. These features include programs operative to: permit a set of user controls to cause the treadmill to initially operate at predetermined speeds; permit the user to design custom workouts; permit the user to switch between workout programs while the treadmill is in operation; and perform an automatic cooldown program where the duration of the cooldown is a function of the duration of the workout or the user's heart rate. The features also include a stop program responsive to a detector for automatically stopping the treadmill when a user is no longer on the treadmill and a frame tag module attached to the treadmill frame having a non-volatile memory for storing treadmill configuration, and operational and maintenance data. Another included feature is the ability to display the amount of time a user spends in a heart rate zone.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a fitness machine providing shock absorption for a user operating the fitness machine. The fitness machine can include a base and a mobile portion engageable by the user and moveable relative to the base during operation of the fitness machine. A resilient body resists movement of the mobile portion towards the base in a height direction, where the resilient body has first and second ends defining a length therebetween, and where the length is defined in a length direction that is perpendicular to the height direction. An end stop is engageable by the resilient body, where the length of the resilient body increases when the mobile portion moves towards the base until the second end engages with the end stop. The resilient body provides shock absorption for the user.

A system is provided for adjusting stiffness of a running deck for a treadmill having a base. The system can include a bracket configured to be coupled to the base of the treadmill. A resilient body resists movement of the running deck towards the base in a height direction, where the resilient body has first and second ends defining a length therebetween, where the length is defined in a length direction that is perpendicular to the height direction, and where the first end is pivotally coupled to the bracket. A stop wall is adjustably fixable relative to the base, where the length of the resilient body is caused to increase when the running deck moves towards the base until the second end engages with the stop wall. An adjustment device is coupled to the stop wall, where the adjust device is configured to move the stop wall in the length direction to change the length of the resilient body when the second end thereof engages with the stop wall.

Various other features, objects and advantages of the disclosure will be made apparent from the following description taken together with the drawings.

BRIEF DESCRIPTION OF THE DRAWINGS

The present disclosure is described with reference to the following drawing.

DETAILED DISCLOSURE

Figure 1:
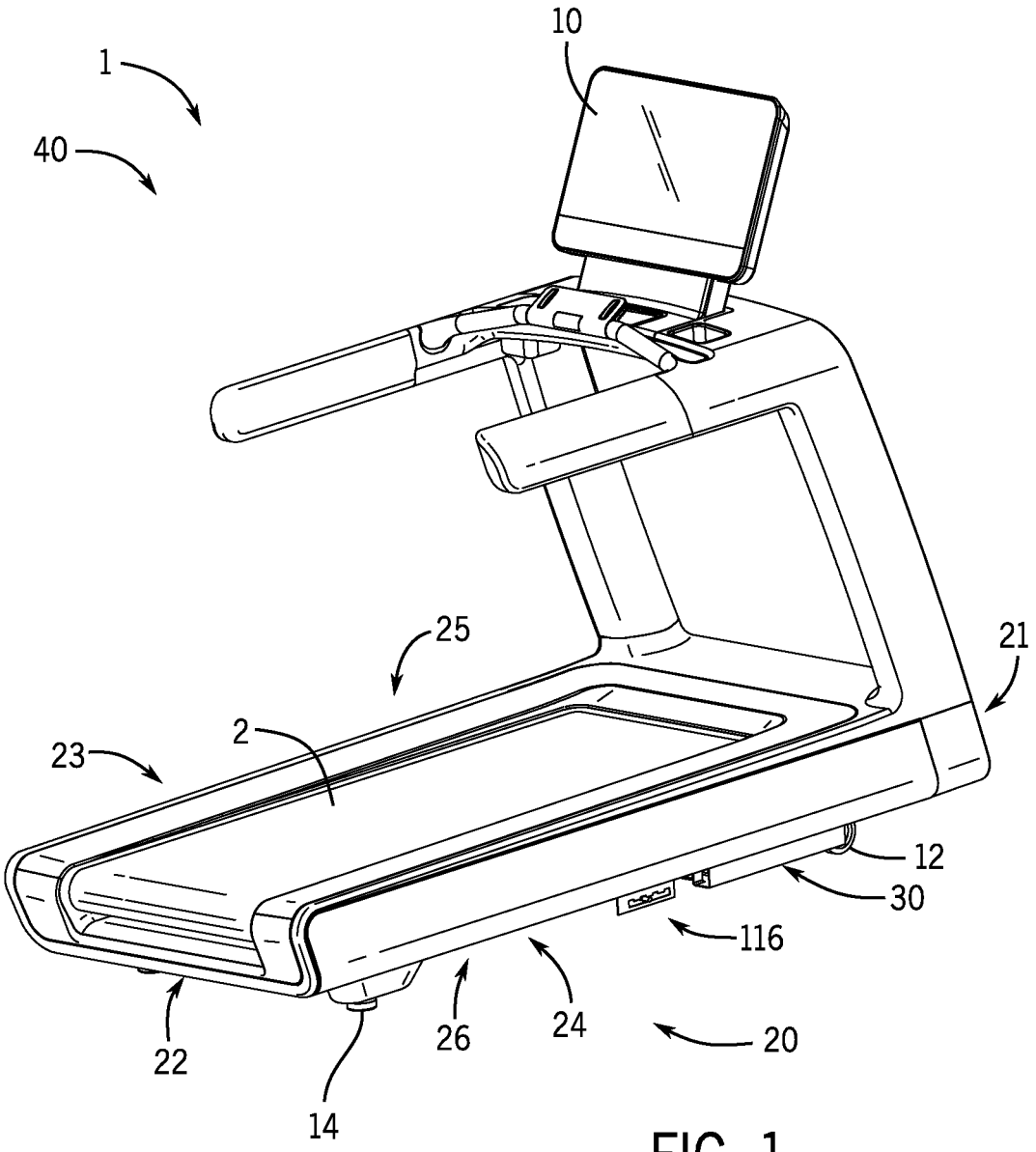
FIG. 1 is a rear perspective view of a fitness machine incorporating an exemplary adjustable shock absorption system according to the present disclosure.
Figure 2:
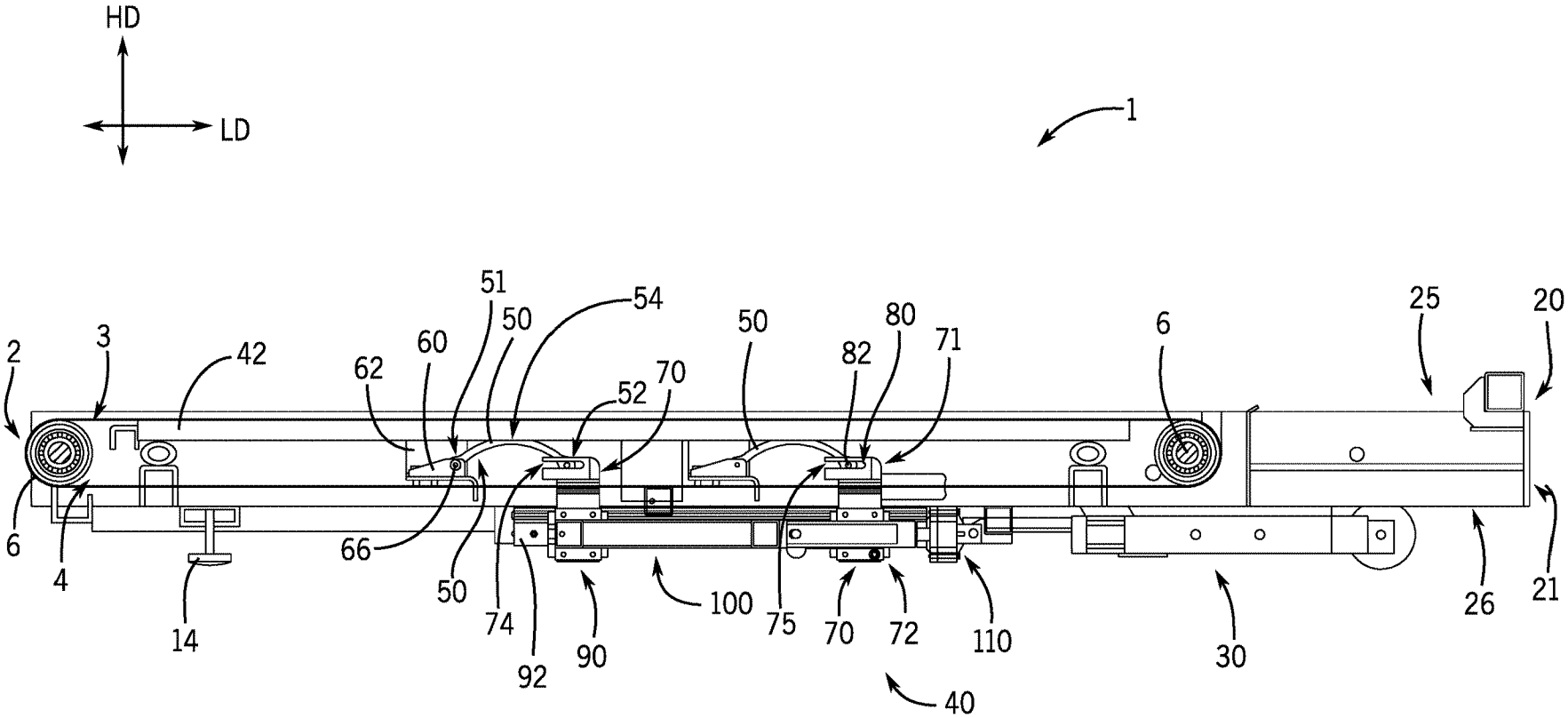
FIG. 2 is a side view of a lower portion of the fitness machine of FIG. 1.

The present disclosure generally relates to systems and methods for providing shock absorption for fitness machines, including systems in which the amount of shock absorption is adjustable. FIG. 1 depicts an exemplary embodiment of a fitness machine 1 incorporating an adjustable shock absorption system 40 according to the present disclosure. In the illustrated embodiment, the fitness machine 1 is a treadmill having a belt 2 that is rotated such that a user may run or walk on the belt 2. FIGS. 1 and 2 show the belt 2 having a running upper strand 3 and a returning lower strand 4 that continuously cycle about belt rollers 6 in a conventional manner. While the present disclosure principally discusses embodiments in which the fitness machine 1 is a treadmill having a motor that rotates the belt 2, it should be recognized that the present disclosure equally applies to treadmills in which forces by the user rotate the belt 2, as well as to fitness machines 1 other than treadmills (e.g., stair climbers).

The fitness machine 1 of FIGS. 1 and 2 is supported on a base 20 having a front 21 and rear 22, left 23 and right 24, and top 25 and bottom 26. Operation of the fitness machine 1 is controlled by a console 10 in a manner known in the art, which for example controls the speed of the belt 2, an incline of the belt 2 relative to a horizontal plane (e.g., via a height adjustment system 30 in a manner known in the art), resistance levels (for example with bicycles, rowers, elliptical trainers, and/or treadmills in which the user rotates the belt), and/or other functions customary for operating fitness machines 1, as known in the art. The base 20 of the fitness machine 1 is supported on feet 14 and casters 12. As will be discussed below, manual controls 116 for adjusting the stiffness may be provided. The manual controls 116 may be moveable by the user in a manner similar to systems known in the art (e.g., here, selectable among 4 stiffness settings). However, as will become apparent, the presently disclosed systems and methods effectuate this stiffness adjustment in a completely different manner.

Through experimentation and development, the inventors have identified that fitness machines presently known in the art typically have a fixed or minimally adjustable "stiffness". In the case of treadmills, this may mean the stiffness of the running surface, for example. Even in fitness machines that do include some degree of adjustable stiffness (for example, the Life Fitness T5 Treadmill), existing systems do not provide a sufficient range of adjustability for the level of stiffness experienced by the user. Likewise, the inventors have identified that with systems presently known in the art, some users (e.g., light weight users) have a difficult time detecting changes in stiffness, for example between medium and soft settings. Additionally, some users of fitness machines require an especially "soft" stiffness, for example for ORANGETHEORY FITNESS® and other workout regimens. The present inventors have found that this is not accomplished by fitness machines that also provide a traditional stiffness, requiring dedicated equipment (and thus increasing the cost for a facility to offer such workout regimens). As such, the present inventors have recognized an unmet need for a fitness machine that offers a full range of stiffness settings, for example from a stiffer setting corresponding to running on concrete down to a very-soft setting corresponding to sand, a gymnastics floor, or a pool springboard, for example.

Figure 3:
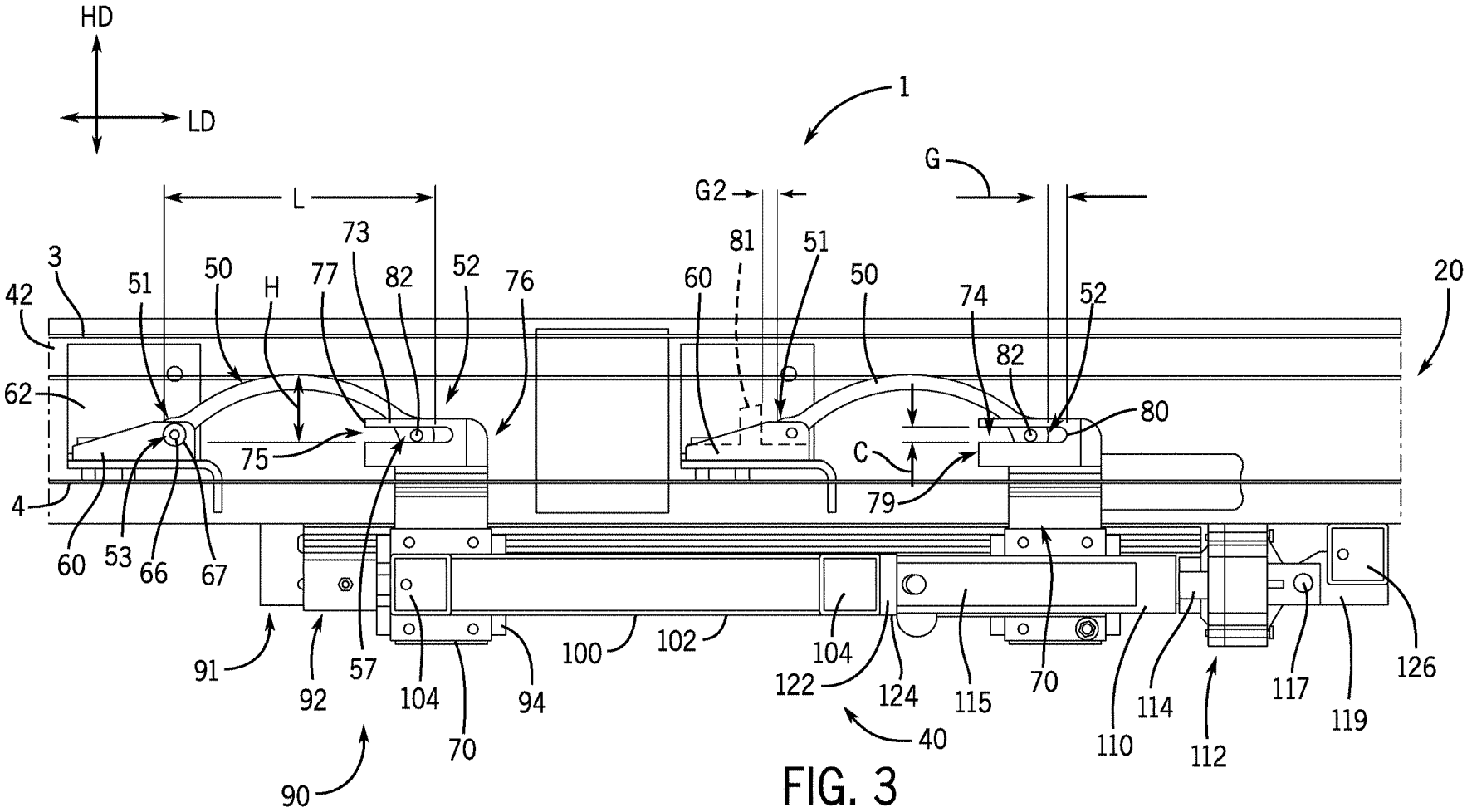
FIG. 3 is a close-up side view of the embodiment similar to that of FIG. 2.

FIGS. 2-3 depict two exemplary systems 40 for providing shock absorption according to the presently disclosure, and in these examples systems 40 in which the shock absorption is adjustable to provide a range of stiffness selections. In each example the fitness machine 1 includes a base 20 and a mobile portion 42 that is engageable by the user, which consequently moves relative to the base 20 during operation of the fitness machine 1. The mobile portion 42 shown is a running deck that supports the belt 2 in a conventional manner, which moves up and down relative to the base 20 from the impact of the user running or walking thereon.

The system 40 include one or more resilient bodies, for example leaf springs 50, that resist movement of the mobile portion 42 towards the base 20, particularly in a height direction HD. In certain embodiments, the leaf spring 50 is made of an elastomeric material, such as rubber, polyurethane, and/or other polymers.

Figure 4:
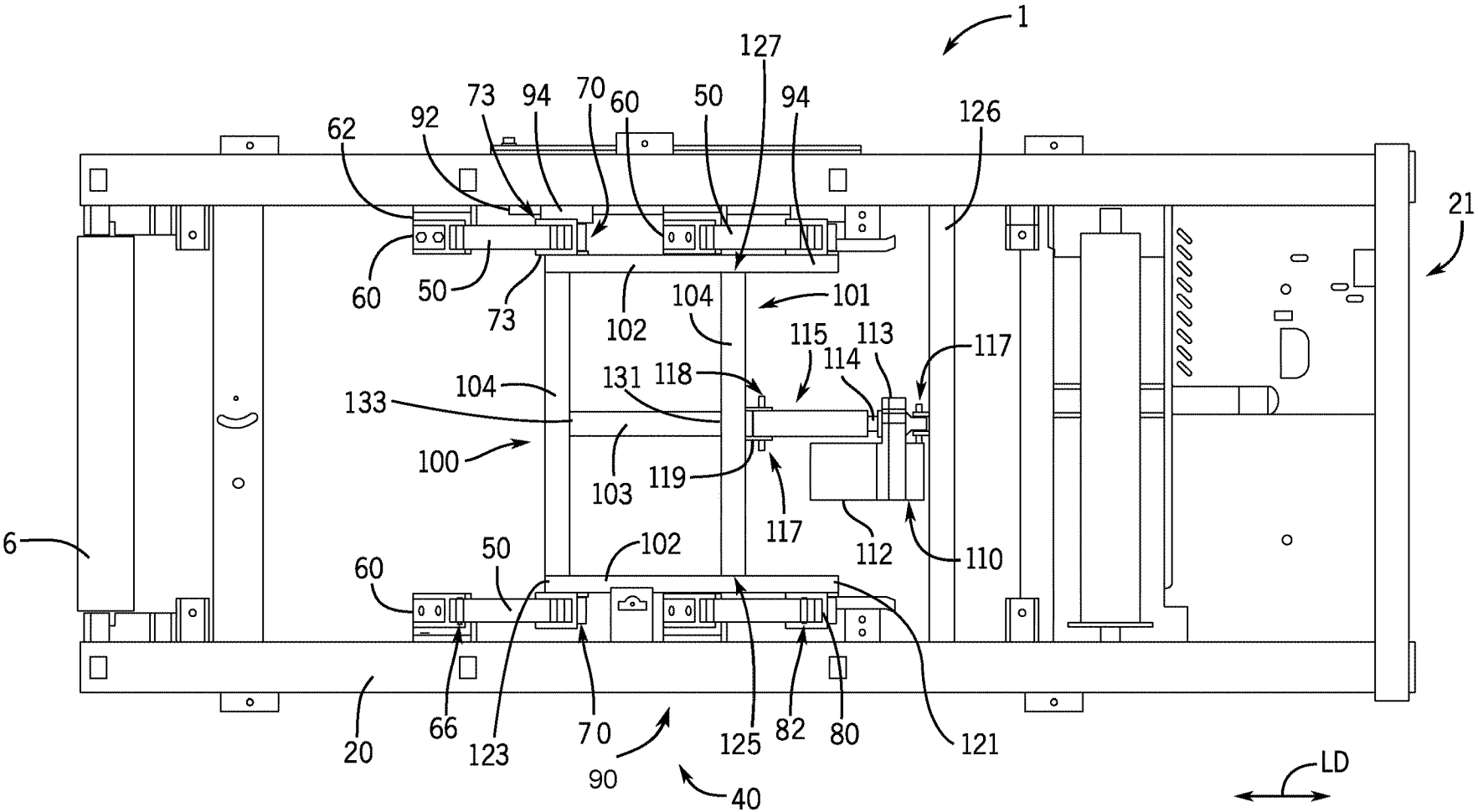
FIG. 4 is a top-down view of the lower portion of the fitness machine of FIG. 1.

The embodiments shown in FIGS. 2-4 each include four distinct and separate leaf springs 50 that work independently. These leaf springs 50 are each configured to function in the same or in a similar manner as the others. Thus, for simplicity, the leaf spring 50 and corresponding function are presently discussed singularly. Likewise, the leaf spring 50 described herein may be used in combination with one or more other shock absorbing devices presently known in the art.

Figure 7:
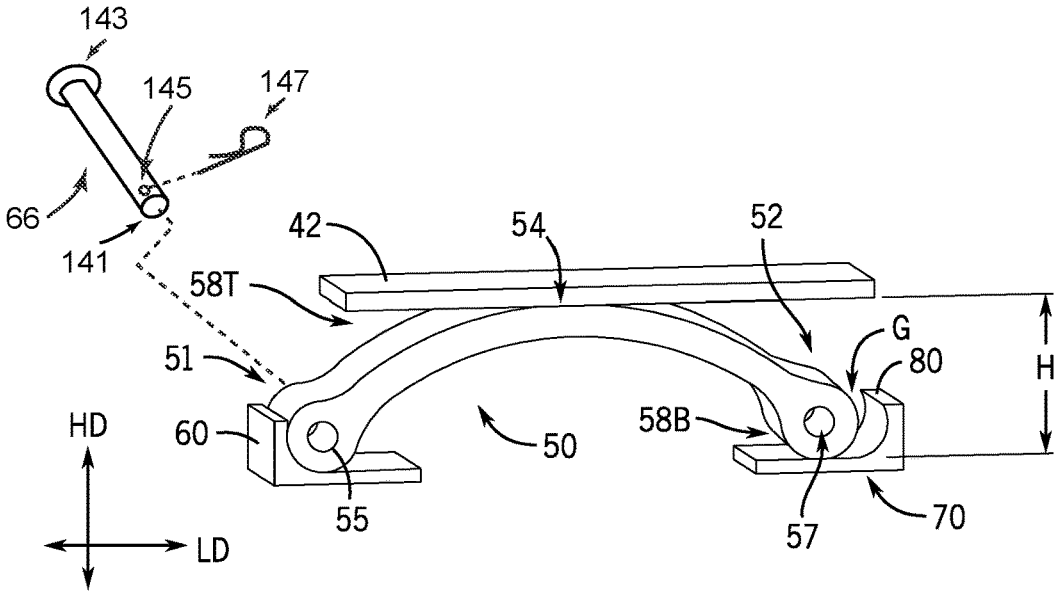
FIG. 7 is a perspective view of an exemplary resilient body such as may be incorporated within an adjustable shock absorbing system according to the present disclosure.
Figure 8:
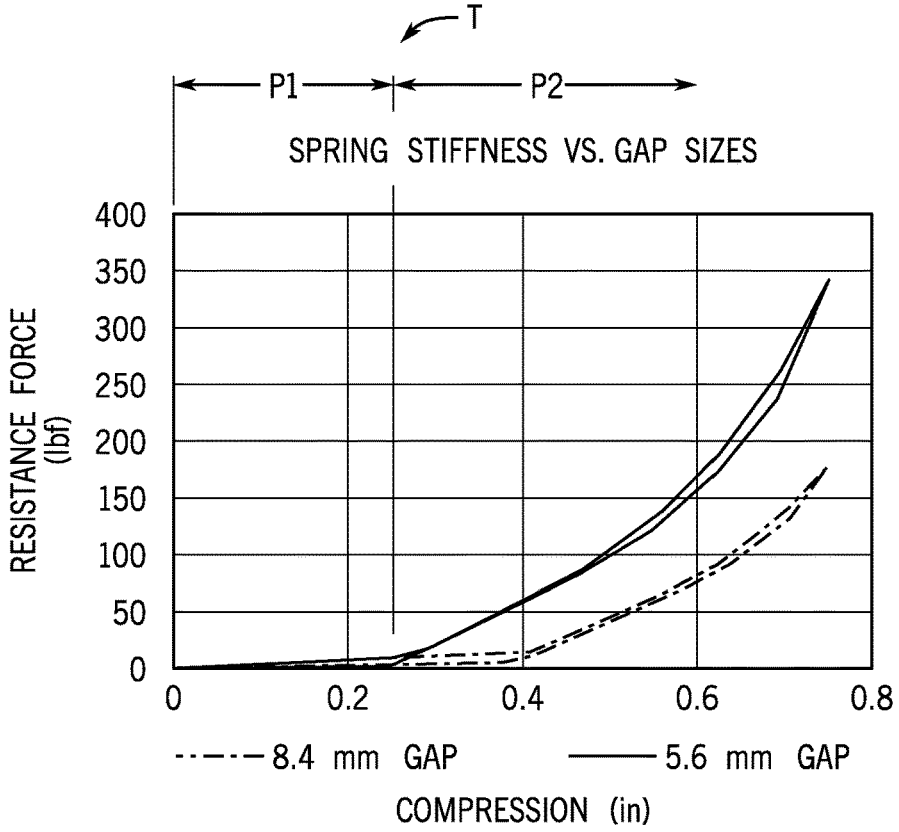
FIG. 8 depicts exemplary data for adjustable shock absorption systems according to the present disclosure, particularly the stiffness versus gap size between a resilient body and an end stop.

FIG. 7 depicts a close-up view an exemplary leaf spring 50 as incorporated within the system 40 of FIGS. 2-4. The leaf spring 50 is a resilient body that extends between a first end 51 and second end 52. A length L is defined between the first end 51 and the second end 52 in a length direction LD that is perpendicular to the height direction HD. The leaf spring 50 has a parabolic shape that opens downwardly and supports the mobile portion 42 at or near a vertex 54 of the parabolic shape. In the example shown, the mobile portion 42 rests on the leaf spring 50 without being coupled to the mobile portion 42.

A first pin hole 55 extends transversely through the leaf spring 50 at the first end 51, and in certain embodiments a second pin hole 57 also extends transversely through the leaf spring at the second end 52. The first pin hole 55 (and second pin hole 57 when present) are each configured to receive a pin such as first pin 66 therethrough, as discussed below. The first end 51 and second end 52 have a substantially circular side profile that is thicker in the height direction HD than the resilient body therebetween for added strength. The first pin hole 55 and second pin hole 57 each also have substantially circular side profiles that are approximately centered within the circular profiles of the first end 51 and the second end 52.

However, this is merely an exemplary configuration for the leaf spring 50, which may be configured to have differing side profiles between the first end 51 and the second end 52 to alter the characteristics of the shock absorption provided by the leaf spring 50, for example.

Figure 5:
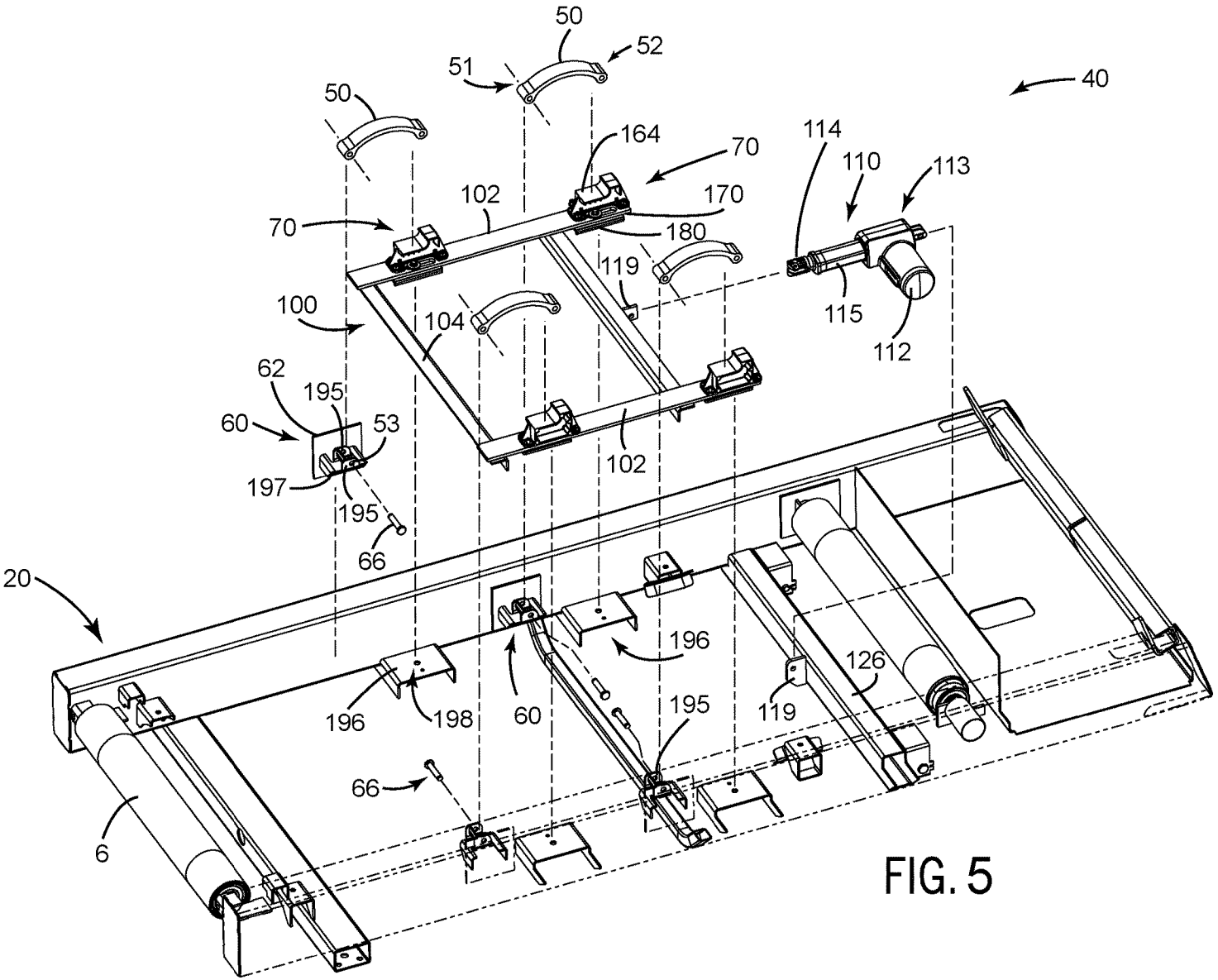
FIG. 5 is an exploded perspective view depicting a system similar to that of FIG. 2.
Figure 6:
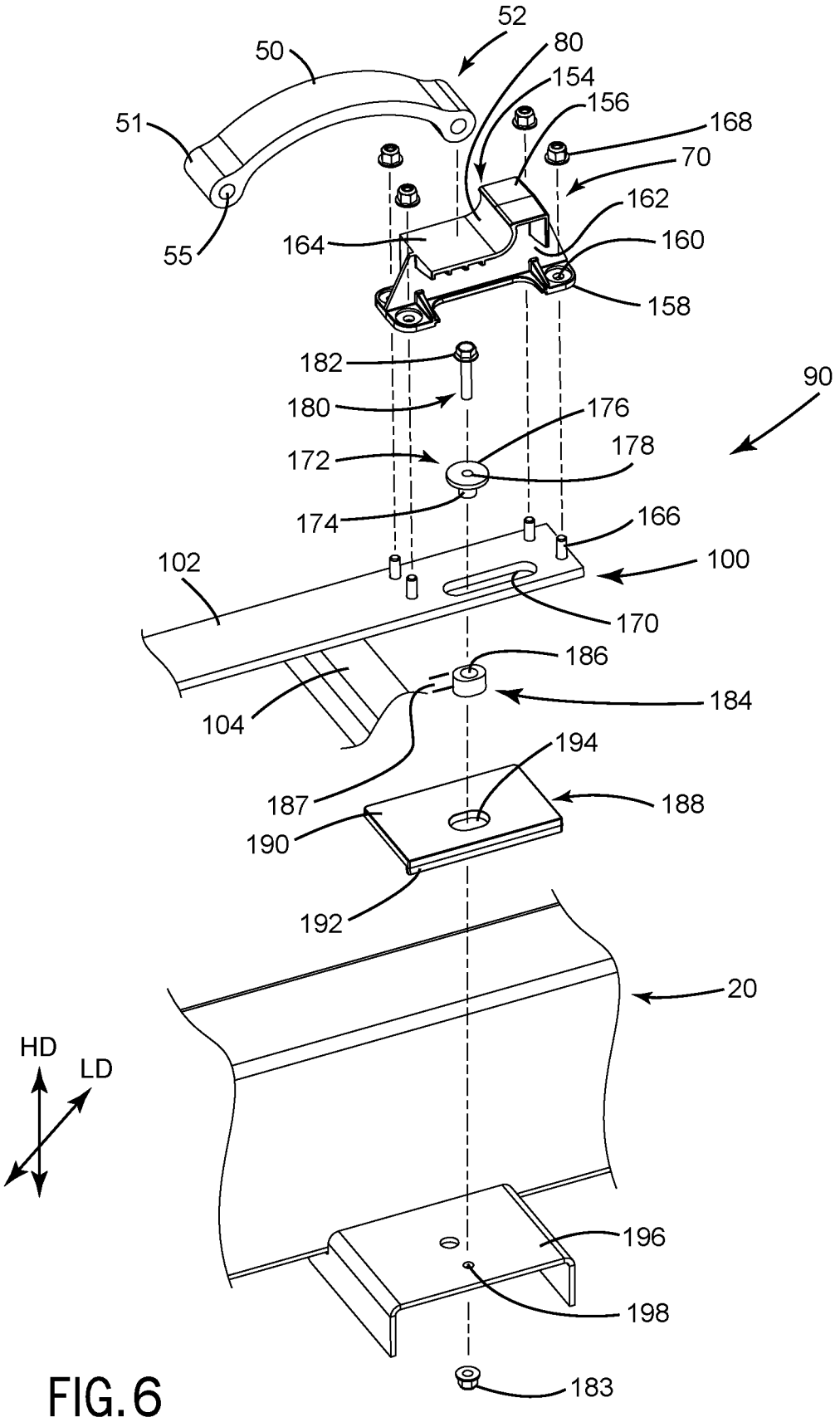
FIG. 6 is a close-up view of the system of FIG. 5.

FIGS. 3 and 5-6 depict how these leaf springs 50 may be coupled between the base 20 and the mobile portion 42, shown here for an adjustable shock absorption system 40 similar to that of FIG. 2. The first end 51 of the leaf spring 50 is pivotally coupled to the base 20 via a bracket 60. The bracket 60 includes a plate 62 with a bottom segment 197 extending perpendicularly away from the plate 62. The plate 62 is coupled to the inside of the base 20, for example via welding, fasteners (e.g., nuts and bolts), or other methods presently known in the art. Two ears 195 extend upwardly from the bottom segment 197 and are substantially parallel to the plate 62. A first pin hole 53 extends through each of the ears 195, the interiors of the first pin holes 53 being smooth or threaded depending on the first pin 66 to be received. The first pin holes 53 are configured to receive a first pin 66, where the first pin 66 is also being received through the first pin hole 55 in the first end 51 of the leaf spring 50 to therefore pivotally couple the leaf spring 50 to the bracket 60.

Returning to FIG. 7, an exemplary first pin 66 is shown extending between a head 143 and tip 141 with a smooth shaft therebetween. An opening 145 is defined near the tip 141 for receiving a cotter pin 147 after the first pin 66 has been received through the bracket 60 (and through the first end 51 of the leaf spring 50). It should be recognized that the bracket 60 depicted in FIG. 7 is shown as only a partial view so as to not obscure the first pin hole 55, omitting the ears 195, for example. Other types of fasteners known in the art may also or alternatively be used as the first pin 66, including those with set screws, threads (e.g., engaging with a nut 67 as shown in FIG. 3), or press fits, those integrated with the leaf spring 50 (e.g., via over-molding), those welded to the bracket 60, and/or those used in conjunction with ears 195 of the bracket 60 that prevent lateral translation of the first pin 66, for example. These same examples for the first pin 66 also apply to a second pin 82 for the second end 52 of the leaf spring 50, which is discussed below.

In this manner, the leaf spring 50 is permitted to freely rotate about the first pin 66, but the first end 51 is prevented from translating in the length direction LD or in the height direction HD relative to the base 20.

As shown in FIGS. 5-6, the systems 40 further include end stops 70 that are fixable relative to the base 20, in the present embodiment in an adjustable manner. A separate end stop 70 is shown provided for each leaf spring 50 in a similar manner as the brackets 60. However, other configurations are also anticipated by the present disclosure. For simplicity, the end stops 70 are principally discussed singularly. In the embodiment of FIGS. 5-6, each end stop 70 extends from a top 156 to bottom 158 with a vertical segment 162 therebetween. Holes 160 are provided through the bottom 158 of the end stop 70 for mounting the end stop 70 to the base 20, specifically via a frame 100 to be discussed further below. The holes 160 receive threaded studs 166 that extend upwardly from the frame 100, in this example four threaded studs 166 for each end stop 70. Nuts 168 engage the threaded studs 166 to retain the end stops 70 on the frame 100. It should be recognized that other methods may be used for coupling the end stops 70 to the frame 100, including welding, other types of fasteners, and/or the like.

For each end stop 70, a floor 164 extends perpendicularly from the vertical segment 162, which intersects at a front end to a stop wall 80 connecting the floor 164 to the top 156. In the embodiment of FIGS. 5-6, the stop wall 80 is concaved such that a lip 154 extends rearwardly from the top 156 where the top 156 meets the stop wall 80. The contour of the stop wall 80 is configured in this manner to correspond with the contour of the second end 52 of the leaf spring 50, for example having a same approximate diameter. The second end 52 of the leaf spring 50 can thus slide forwardly along the floor 164 of the end stop 70 in the length direction LD until it engages the stop wall 80. The lip 154 that extends rearwardly from the top 156 is thus configured to prevent the second end 52 of the leaf spring 50 from moving upwardly in the height direction HD upon contacting the stop wall 80. It should be recognized that the lip 154 is not required and other forces such as the weight of the moving portion 42 and the user also act to prevent movement of the second end 52 upwardly in the height direction HD.

Certain embodiments of systems 40 according to the present disclosure provide that the position each end stop 70 is adjustable in the length direction LD relative to the base 20, which as will become apparent provides adjustability of the stiffness for the fitness machine 1. As shown in FIGS. 3 and 7, a gap G exists between the second end 52 of the leaf spring 50 (or in certain embodiments discussed below, a second pin 82 extending therethrough) and the stop wall 80 of the end stop 70. This gap G is greater when the user is not generating any force on the mobile portion 42, for example when the user is mid-air while running on a treadmill. Since the stop wall 80 limits the forward translation of the second end 52 of the leaf spring 50, the gap G between the second end 52 and the stop wall 80 can be adjusted to modify the amount and/or characteristics of shock absorption being provided by the leaf spring 50.

The position of the stop wall 80 for an end stop 70 is adjustable by moving the support frame 100 to which the end stop 70 is coupled, as described above. As shown in FIGS. 4-5, the support frame 100 includes cross members 104 extending between a first end 125 and a second end 127 that run perpendicular to the length direction LD, as well as side members 102 extending between a first end 121 and second end 123 and a mid-support 103 extending between a first end 131 and second end 133 that all run parallel to the length direction LD. The cross members 104, side members 102, and mid-support 103 may vary in number from that shown and may be coupled together and/or integrally formed, for example. The end stops 70 are coupled to the support frame 100 such that when multiple leaf springs 50 are provided, one or more leaf springs 50 (and therefore the gaps G associated therewith) are adjustable together.

With reference to FIGS. 4-6, the support frame 100 is translatable relative to the base 20 in the length direction LD via engagement within a track system 90. In this embodiment, support beams 196 extend inwardly from the base 20, each of which having a hole 198 in the height direction HD. A base 188 rests on the top of the support beam 196. In the example shown, the base 188 includes a plate 190 that rests on the top of the support beam 196, and wall 192 extending perpendicularly downwardly from the plate 190. The wall 192 engages with an inside edge of the support beam 196 to prevent rotation of the base 188 relative to the support beam 196.

An elongated hole 194 is provided through the plate 190 of base 188. An elongated standoff 184 having an exterior shape substantially matching the interior shape of the elongated hole 194 is received in part within the elongated hole 194. A hole 186 is defined through the elongated standoff 184 in the height direction HD, which in the present example has a circular cross section. As shown in FIG. 6, the elongated standoff 184 is also received in part within a slot 170 defined within the support frame 100, specifically through the side members 102 in close proximity to the mounting location of each end stop 70. The exterior shape of the elongated standoff 184 is also configured to have a width 187 corresponding to a width of the slot 170 in the support frame 100. In the example shown, a top of the elongated standoff 184 is substantially flush with a top for the side member 102 of the support frame 100 when assembled.

A flanged coupler 172 has a flange top 176 with a barrel 174 extending downwardly therefrom. A hole 178 is defined through the flanged coupler 172. The barrel 174 is configured to have an outer diameter corresponding to the interior diameter of the hole 186 in the elongated standoff 184 such that the barrel 174 is received therein. When assembled, the underside of the flange top 176 is approximately flush with the top of the side member 102, preventing movement in the height direction HD. A fastener 180 (e.g., a bolt) having a head 182 is received through the flanged coupler 172, the elongated standoff 184, the base 190, and the hole 198 in the support beam 196 and threadingly engages a nut 183 on the opposite side of the support beam 196. It should be recognized that alternate methods of fastening known in the art may also be used. Once coupled together in this manner, the support frame 100 is translatable in the length direction LD by the elongated standoff 184 sliding within the slot 170, but prevented from rotating (i.e., due to like-engagement between the support frame 100 and other support beams 196 of the base 20), moving transversely, or moving in the height direction HD.

It should be recognized the present disclosure also anticipates embodiments in which there are multiple, separate support frames 100 for changing the positions of one or more leaf spring 50 separately from other leaf springs 50. For example, leaf springs 50 could be adjusted independently, all together, or in subgroups. In certain embodiments, two support frames 100 may be provided to enable separate adjustment between front and rear pairs of leaf springs 50. This separation of adjustability enables one set of leaf springs 50 to travel a greater distance than another set of leaf springs 50, for example.

The support frame 100 and particularly its position in the length direction LD may be moved and locked in place using various forms of hardware known in the art. For example, a manual adjustment mechanism may be provided, such as a threaded hand crank or fasteners coupling the support frame 100 to discrete openings within the base 20 (e.g., the manual controls 116 of FIG. 1 in a manner known in the art). Alternatively, cam locks as presently known in the art may be used to lock the support frame 100 to the base 20 once in the desired position, for example. The locking hardware may be electrically actuated, including electrically actuated cams.

With reference to FIG. 3-5, the support frame 100 is moveable via an actuator 110, which may be operated via electrical momentary switches, a control system 200 as discussed below (including via the console 10), or other methods known in the art. The actuator may be an electrical, pneumatic, and/or hydraulically actuator known in the art. For example, a mechanism similar to a conventional height adjustment mechanism 30 (see FIG. 1) for a treadmill could be employed to move the support frame 100. One such commercially available height adjustment mechanism is Treadmill incline motor lift actuator OK65-01192-0002/CMC-778, produced by P-Tech USA. The actuator 110 may also itself provide the locking function for the positioning of the support frame 100.

The actuator 110 is coupled between the base 20 and a front end 101 of the support frame 100 to translate the support frame 100 relative to the base 20 in the length direction LD. Specifically, a first end of the actuator 110 is coupled to a cross member 126 of the base 20 with brackets 119 and fasteners 117, such as bolts, pins, and/or the like. An opposite end of the actuator 110 is coupled to the support frame 100, also via a bracket 119 and fastener 117 in a conventional manner, which may be the same bracket 119 and/or fastener 117 provided between the actuator 110 and the cross member 126 as described above. It should be recognized that the actuator 110 may be coupled between the base 20 and support frame 100 in alternate positions as well. Likewise, other types of actuators 110, including scissor-type actuators, rack and pinion actuators, and/or other configurations known in the art may also be used.

The exemplary actuator 110 of FIGS. 4-5 includes a motor 112 that rotatably engages with a gearbox 113. Rotation of the motor 112 extends or retracts a rod 114 relative to a housing 115 of the gearbox 113 in the length direction LD. Specifically, rotation of the motor 112 in a first direction causes rotation of the rod 114 through the gearbox 113, where a threaded engagement between the outer diameter of the rod 114 and the interior of the housing 115 causes the rod 114 to extend or retract in the length direction LD relative to the housing 115 as the motor 112 rotates. In contrast, rotation of the motor 112 in an opposite direction causes retraction of the rod 114 in the opposite manner. It should be recognized that either the rod 114 or the housing 115 may be coupled to the support frame 100 (with the other to the base 20), depending on the configuration of the actuator 110. In this manner, operating the actuator 110 causes movement of the support frame 100 relative to the base 20. This movement of the support frame 100 consequently adjusts the gap G between the leaf springs 50 and the stop walls 80 of the corresponding end stops 70, as discussed above. In the example shown, all leaf springs 50 are adjusted simultaneously and equivalently (i.e., a same distance in the length direction LD).

With reference to FIGS. 3-4, it should be recognized that the length L between the first end 51 and the second end 52 of the leaf spring 50 is caused to increase when the mobile portion 42 moves towards the base 20 during operation of the fitness machine 1. In other words, the parabolic shape of the leaf spring 50 is caused to flatten during use. However, the length L of the leaf spring 50 may be constrained by engagement between the second end 52 and the stop wall 80 of the end stop 70. Once the length L can no longer increase, the leaf spring 50 may further resist movement of the mobile portion 42 towards the base 20, but now through a different mechanism, namely, compression of its resilient material. Therefore, adjusting the gap G between the leaf spring 50 and the stop wall 80 of the end stop 70 adjusts the allowable length L of the leaf spring 50, and thus the profile of resistance provided by the system 40, which consequently adjusts the stiffness of the fitness machine 1.

The resistance provided by the system 40 varies depending upon whether the second end 52 of the leaf spring 50 is engaging the stop wall 80, creating two or more distinct phases. In an initial phase referred to as first phase P1 (discussed further below and shown in FIG. 6), the resistance provided by the leaf spring 50 against movement between the mobile portion 42 and the base 20 is primarily provided via bending deformation of the leaf spring 50. In other words, the length L of the leaf spring 50 may change, increasing as the mobile portion 42 moves towards the base 20. However, once the second end 52 engages with the stop wall 80 of the end stop 70 (or second pin 82 extending therethough for an embodiment discussed further below), which is been fixed relative to the base 20, a second phase P2 begins in which a length L of the leaf spring 50 can no longer change. At this stage, further movement of the mobile portion 42 towards the base 20 is resisted by the leaf spring 50 primarily by compressing the leaf spring 50, rather than by bending the leaf spring 50 as provide during phase 1 P1. In other words, the parabolic shape can no longer get wider longer, and thus the leaf spring 50 starts to compress. In certain embodiments, the term "primarily" with respect to the basis for resistance means the basis has a greater contribution than any other basis (i.e., bending contributing to the resistance more than compressing contributes to the resistance). In certain embodiments, the basis having the greatest contribution provides more than 50% of the total resistance. In certain configurations, approximately 50%, 70%, 80%, 90%, 95%, or other portions of the stiffness is provided in phase 2 P2.

As shown in FIGS. 8 and 9A-9D, the resistance provided by the leaf spring 50, also referred to as spring stiffness, is thereby provided as a function of whether the resistance is in phase one P1 or phase two P2. Likewise, the selection of when a transition T from phase one P1 to phase two P2 occurs (i.e., the position of the mobile portion 42 relative to the base 20) is based upon the gap G provided between the second end 52 of the leaf spring 50 and the stop wall 80. In certain embodiments, the leaf spring 50 is selected such that the resistance provided in phase one P1 is substantially lower than the resistance provided in phase two P2 (I think the statement is always true rather than in certain embodiments. It would not work otherwise.). For example, in certain cases the spring stiffness in phase one P1 is no more than 50 percent of the spring stiffness in phase two P2. In further examples, the spring stiffness in phase one P1 is no more than 10 percent of the spring stiffness in phase two P2, or one order lower.

It should be recognized that while the present disclosure generally refers to the leaf spring 50 providing a resistance in each of the phases, here phase one P1 and phase two P2, the resistance may also be considered a resistance profile. For example, the resistance need not be constant, nor linear within a given phase (such as in phase two P2 of FIG. 8). It should also be recognized that the larger the gap G between the second end 52 of the leaf spring 50 and the stop wall 80, the greater the deflection of the mobile portion 42 relative to the base 20 before phase 2 P2 is entered. In other words, a larger gap G provides for more deflection within the softer stiffness of phase one P1. As discussed above, the systems 40 and methods presently disclosed allow the user to fully configure the stiffness of the shock absorption for the fitness machine 1, and specifically when this greater resistance of phase two P2 is felt by the user.

It should be recognized that additional phases may also be provided by the system 40 according to the present disclosure. For example, instead of pivotally fixing the first end 51 of the leaf springs 50 to the bracket 60, the first end 51 may also be translatable in the length direction LD in a similar or same manner as the second end 52. An example of this configuration is shown in FIG. 3, specifically for the forward-most bracket 60 shown. A stop wall 81 is integral with or coupled to the bracket 60, which provides a limit for the first end 51 of the resilient body 50 moving rearwardly. The stop wall 81 thus prevents translation of the first end 51 of the leaf spring 50 without the use of a first pin 66. Other features may also be included to restrict movement of the first end 51 in the height direction HD, for example, such as the slot 74 discussed for the end stop 70 discussed above. In this embodiment, the first end 51 has a gap G2 of travel before being constrained by stop wall 81, thereby changing the overall resistance profile for the system 40 relative to the pivoting embodiment of the rear-most bracket 60 shown. Additional phases or impacts to the overall resistance profile may be provided by controlling one or more leaf springs 50 separately from others, such as having a gap G (and/or gap G2) that is greater for rear leaf springs 50 relative to forward leaf springs 50, for example.

It will also be understood that the leaf spring 50 need not be shaped as shown in the figures, which may also or alternatively vary in number and/or position relative to the base 20 and mobile portion 42 of the fitness machine 1. The positions of the leaf springs 50 relative to the base 20 may also be adjustable in ways other than adjusting the gap G between the leaf spring 50 and the stop wall 80 (and/or gap G2 for stop wall 81). Similarly, the end stops 70 may be adjustable in the height direction HD in addition to, or in the alternative to in the length direction LD, further modifying the manner in which the adjustments change the resistance profiles of the leaf springs 50.

Additional testing results for a fitness machine 1 and system 40 as shown in FIGS. 2-4 are provided in FIGS. 9A-9D, which were tested on a hydraulic MTS® test system in which the leaf springs 50 were compressed for 0.45 inches in the height direction HD in 2 Hz and 5 Hz sinusoidal motion-controlled mode. In the plots, the horizontal axes represent the amount of compression (the same for the four plots), while the vertical axes represent the applied forces to reach the corresponding deformations. The scale of the vertical axes is kip, or 1000 lbf.

Figure 9A:
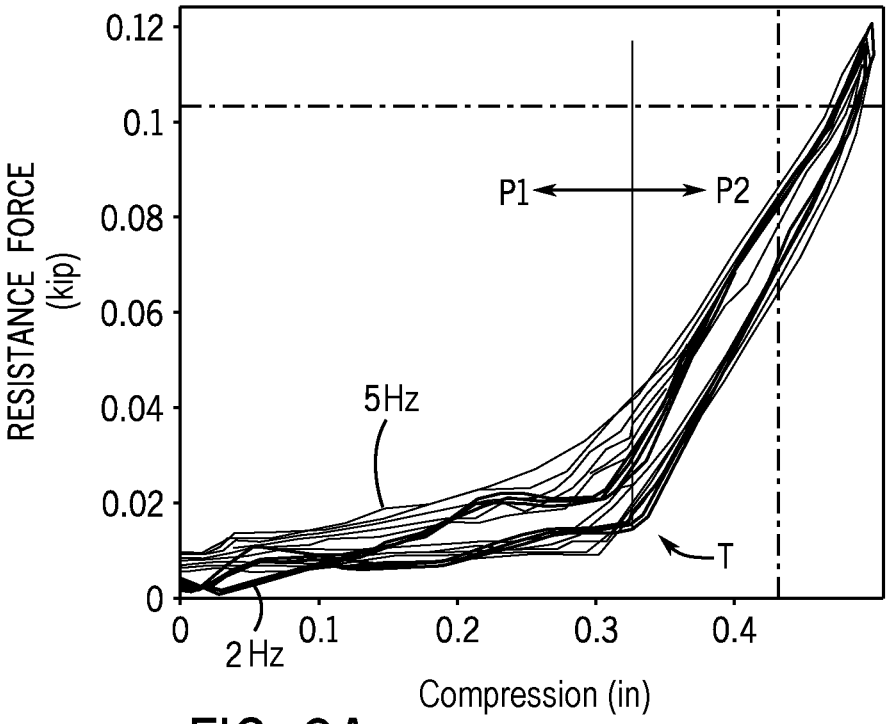
FIGS. 9A-9D depict further exemplary data for testing adjustable shock absorption systems according to the present disclosure.
Figure 9B:
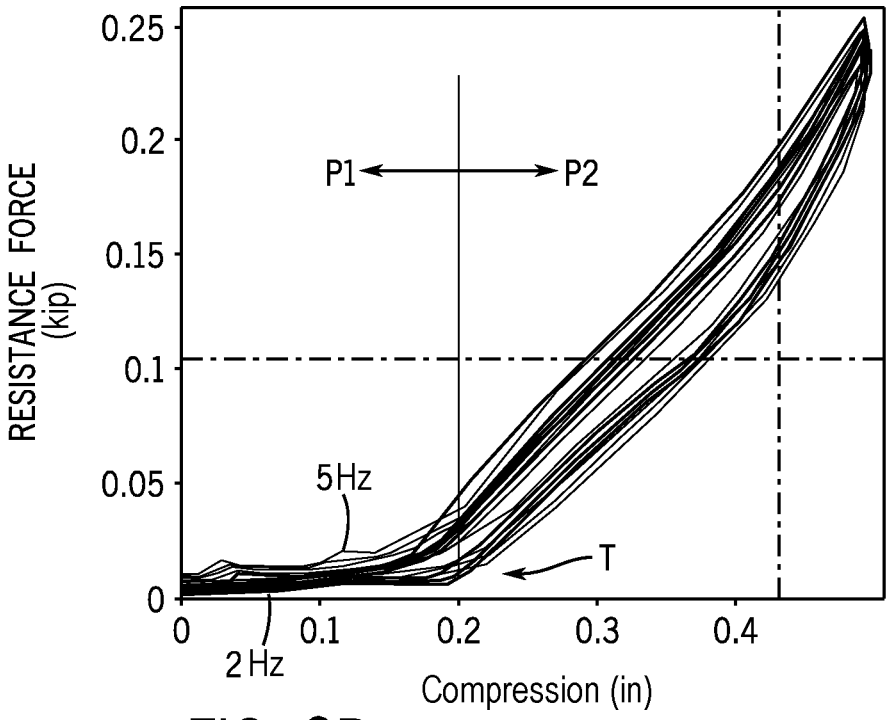
Figure 9C:
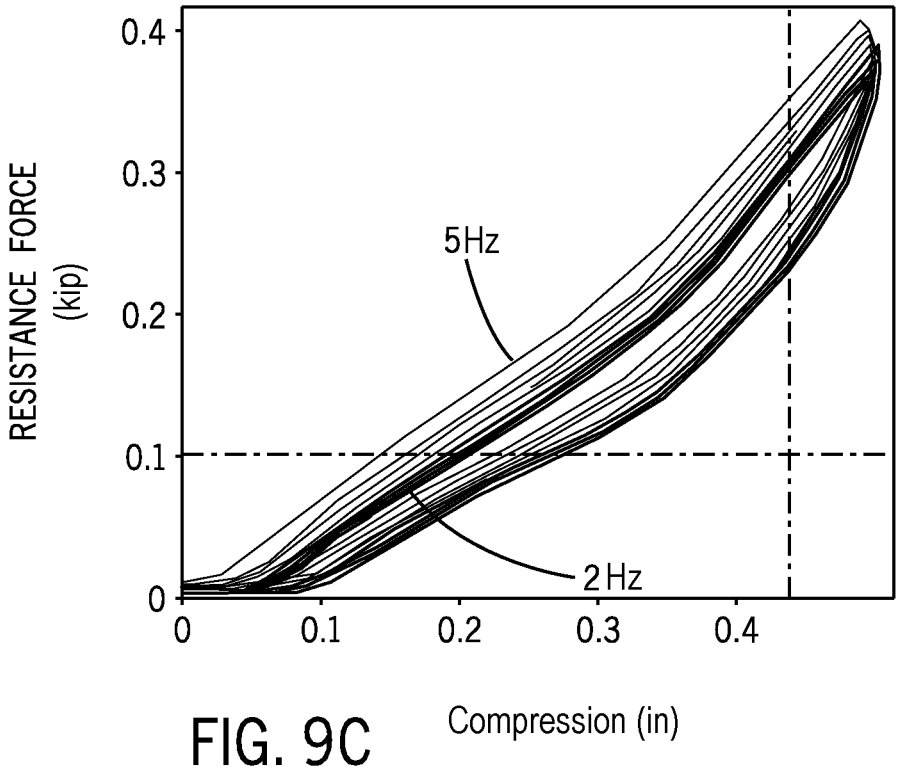
Figure 9D:
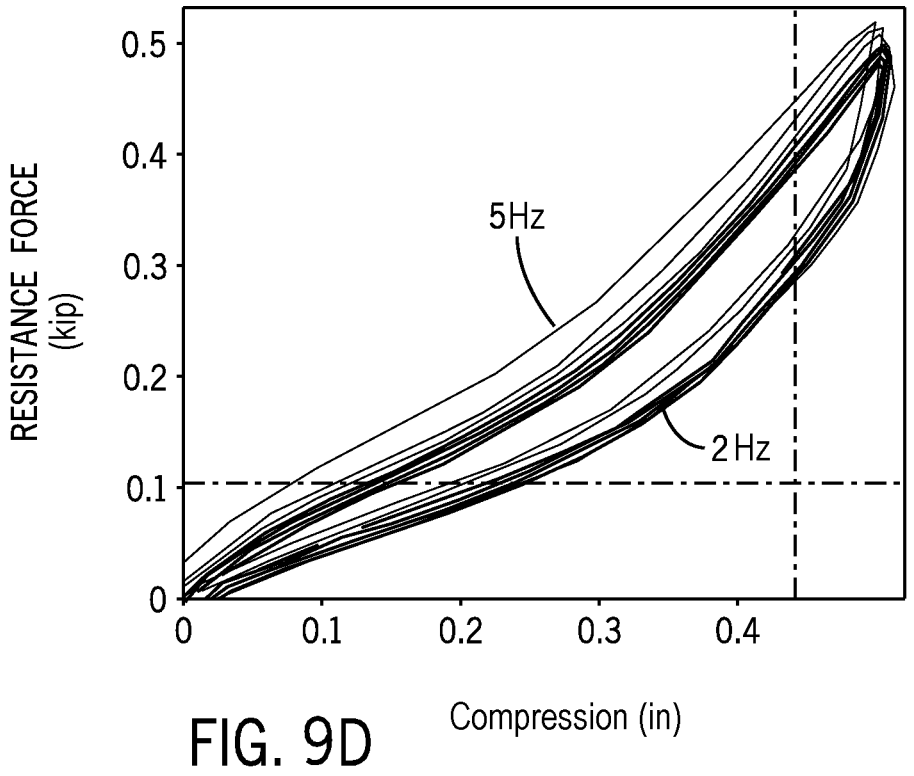

The curves demonstrate that there was little difference between responses under the two tested frequencies. FIG. 9D depicts the results when the leaf spring 50 was constrained at the original length L (no gap G to the stop wall 80), whereby the resultant force reached about 500 lbf at 0.45 inch vertical travel. FIG. 9C was tested with 25% gap G (the percentage compared to the maximum gap, or equivalently the gap G needed to let the leaf spring 50 free bend into a straight beam. In this case, 25% was about 2.8 mm, where the peak loading reached about 400 lbf. FIG. 9B was tested at 50% gap G (about 5.6 mm), where about 250 lbf was needed to compress the spring down by 0.45 inch. FIG. 9A was tested at 75% gap G, with maximum force of about 120 lbf. Collectively these results demonstrate how the stiffness of the fitness machine 1 can be effectively controlled using the system 40 presently disclosed.

FIGS. 2-3 depict an alternative configuration for an end stop 70, which may be used alone or in conjunction with the end stop 70 discussed above for the system 40 of FIGS. 5-6. In this embodiment, the stop wall 80 is formed at the end or termination of a slot 74 defined within the sides of the end stop 70. Specifically, the end stop 70 has a top 71 with two arms 73 that extend rearwardly from a front 76 to finger tips 77. In the example shown, the finger tips 77 extend from the front 76 of the end stop 70 approximately the same distance as do base tips 79 such that a slot 74 is formed between the finger tip 77 and base tip 79 on each side of the end stop 70. As shown in the top-down review of FIG. 4, providing two arms 73 for each end stop 70 allows the leaf spring 50 to be positioned between the arms 73, which retains the leaf spring 50 in position relative to the left 23 and right 24 of the fitness machine 1.

This embodiment of end stop 70 is configured such that a second pin 82 extending through the second pin hole 57 in the second end 52 of the leaf spring 50 is translatable in the length direction LD within the slot 74. The second pin 82 is insertable into the slot 74 at least via the open end 75 opposite a stop wall 80 and front 76. The clearance C of the slot 74 is selected based on the diameter of the second pin 82 such that no movement is permitted in the height direction HD. Forward translation of the second end 52 of the leaf spring 50 may thus be prevented by engagement between the stop wall 80 and the second pin 82 extending through the second end 52, and/or engagement between the stop wall 80 and the second end 52 itself.

With continued reference to FIGS. 2-3, the second pin 82 may be the same or similar to the first pin 66, or be formed of other hardware known in the art. In certain examples, the second pin 82 and/or first pin 66 are rods retained in place via cotter pins and/or the like. In another example, the second pin 82 and/or first pin 66 are over-molded to be retained on the leaf spring 50 to extend outwardly therefrom, for example. Whether or not first pins 66 and/or second pins 82 are used, the leaf spring 50 may also or alternatively be coupled to the mobile portion 42, for example at the vertex 54.

The present disclosure also anticipates differing configurations for the support frame 100 being translatably moveable relative to the base 20 in the length direction LD. FIG. 3 depicts an embodiment of a system 40 providing this adjustment via engagement via a different track system 90 than discussed above. This track system 90 includes a sliding track 92 that is coupled to the base 20 via track mounts 91. Specifically, a track riding bracket 94 is coupled to the support frame 100, for example on the side members 102. The track riding bracket 94 slideably engages with the sliding track 92, which may function similarly to a conventional drawer slide having roller bearings, incorporate a rack and pinion engagement, and/or other sliding mechanisms known in the art. The support frame 100 may then be locked relative to the base 20 in a manner known in the art and as discussed above.

Figure 10:
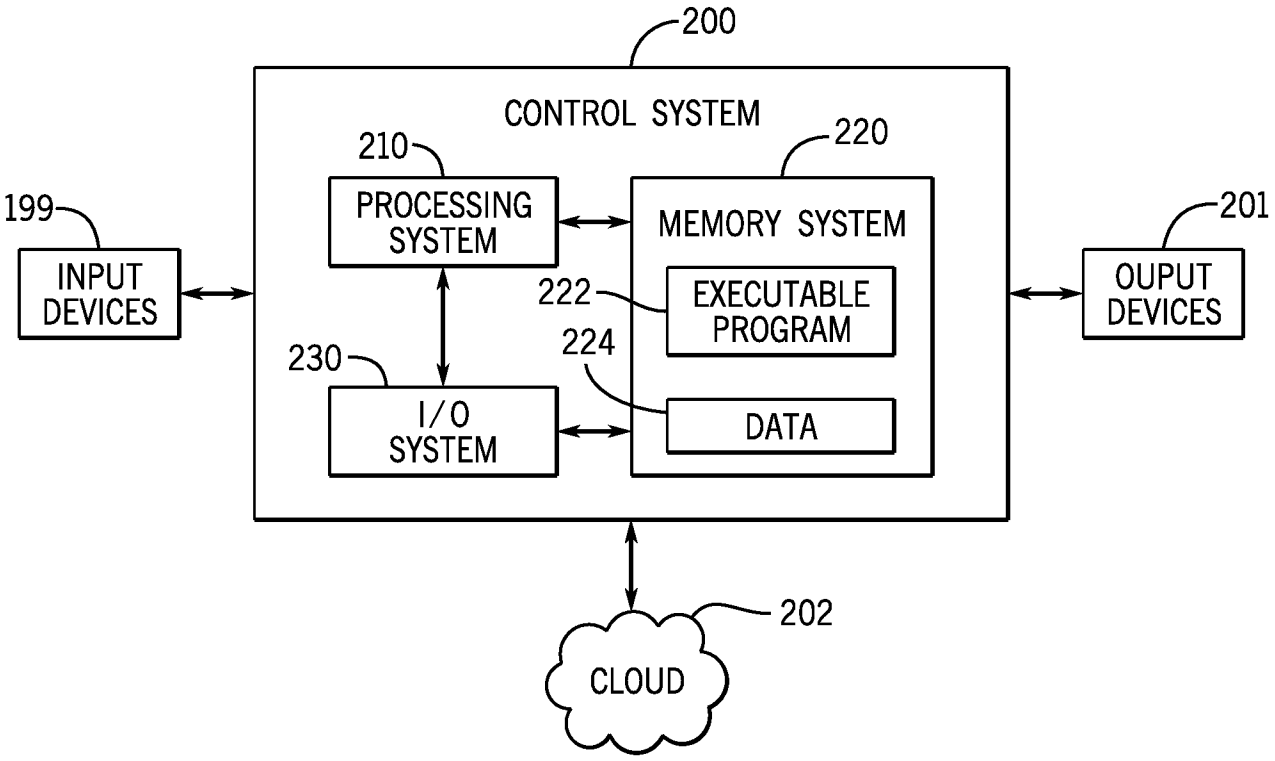
FIG. 10 depicts an exemplary control system for operating adjustable shock absorption systems according to the present disclosure.

Certain embodiments of system 40 for adjusting the stiffness of fitness machine 1 incorporate the use of a control system 200. FIG. 10 depicts an exemplary control system 200 for adjusting the stiffness for a fitness machine 1, which may be manually operated by the user and/or automatically selected or modified according to a given program controlled by the console 60. The control system 200 in certain embodiments automatically modifies the stiffness according to a changing program or other factors such as user's body weight or fitness levels. For example, the stiffness may be automatically modified when a program for the fitness machine 1, such as a treadmill, transitions from simulating running on a trail versus running on a road (here, transitioning from soft to firm stiffnesses), for example.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, such as shown in FIG. 10, the control system 200 communicates with each of the one or more components of the system 40 via a communication link CL, which can be any wired or wireless link. The control system 200 is capable of receiving information and/or controlling one or more operational characteristics of the system 40 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the fitness machine 1. Moreover, the communication link CL lines are meant only to demonstrate that the various control elements are capable of communicating with one another, and do not represent actual wiring connections between the various elements, nor do they represent the only paths of communication between the elements. Additionally, the system 40 may incorporate various types of communication devices and systems, and thus the illustrated communication links CL may in fact represent various different types of wireless and/or wired data communication systems.

The control system 200 may be a computing system that includes a processing system 210, memory system 220, and input/output (I/O) system 130 for communicating with other devices, such as input devices 199 and output devices 201, either of which may also or alternatively be stored in a cloud 202. The processing system 210 loads and executes an executable program 222 from the memory system 220, accesses data 224 stored within the memory system 220, and directs the system 40 to operate as described in further detail below.

The processing system 210 may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices.

The memory system 220 may comprise any storage media readable by the processing system 210 and capable of storing the executable program 222 and/or data 224. The memory system 220 may be implemented as a single storage device, or be distributed across multiple storage devices or sub-systems that cooperate to store computer readable instructions, data structures, program modules, or other data. The memory system 220 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A fitness machine providing shock absorption for a user operating the fitness machine, the fitness machine comprising:

a base;

a mobile portion engageable by the user and moveable relative to the base during operation of the fitness machine;

a resilient body that resists movement of the mobile portion towards the base in a height direction, wherein the resilient body has first and second ends defining a length therebetween, and wherein the length is defined in a length direction that is perpendicular to the height direction; and a stop wall engageable by the resilient body, wherein the length of the resilient body increases when the mobile portion moves towards the base until the second end engages with the stop wall;

wherein the resilient body provides shock absorption for the user; and wherein the stop wall is adjustable in the length direction to change the length at which the resilient body engages with the stop wall.

2. The fitness machine according to claim 1, wherein the fitness machine is a treadmill and the mobile portion is a running deck supporting a belt on which the user runs.

3. The fitness machine according to claim 2, wherein the resilient body is a first resilient body and the stop wall is a first stop wall, further comprising additional resilient bodies and additional stop walls functionally equivalent to the first resilient body and the first stop wall, respectively, and wherein the running deck is supported at least in part atop the first resilient body and the additional resilient bodies.

4. The fitness machine according to claim 3, wherein the first stop wall and the additional stop walls are moveable together in the length direction to all be simultaneously and equivalently adjusted.

5. The fitness machine according to claim 4, further comprising an adjustment frame on which the first stop wall and the additional stop walls are each coupled, and further comprising an actuator that moves the adjustment frame in the length direction such that the first stop wall and the additional stop walls are together adjustable relative to the base.

6. The fitness machine according to claim 1, wherein the first end of the resilient body is non-translatably coupled to the base.

7. The fitness machine according to claim 6, wherein the stop wall is an end of a slot defined within an end stop, wherein the slot extends in the length direction, and wherein the second end of the resilient body is moveable within the slot.

8. The fitness machine according to claim 7, wherein the slot prevents the second end from moving in the height direction.

9. The fitness machine according to claim 1, wherein the mobile portion is moveable in the height direction towards the base in first and second phases, wherein in the second phase the stop wall limits the length of the resilient body, wherein in the first phase the mobile portion moves towards the base principally via bending of the resilient body, and wherein in the second phase the mobile portion moves towards the base principally via compression of the resilient body.

10. The fitness machine according to claim 9, wherein a resistance provided by the resilient body to resist movement of the mobile portion is less in the first phase than in the second phase.

11. The fitness machine according to claim 10, wherein the stiffness of the resilient body in the first phase is at most 50% of the stiffness in the second phase.

12. The fitness machine according to claim 1, wherein the resilient body has a parabolic shape with a vertex positioned between the first and second ends.

13. The fitness machine according to claim 12, wherein the mobile portion is supported at least in part by the vertex of the resilient body.

14. The fitness machine according to claim 1, wherein the resilient body is an elastomer.

15. A system for adjusting a stiffness of a running deck for a treadmill having a base, the system comprising:

a bracket configured to be coupled to the base of the treadmill;

a resilient body that resists movement of the running deck towards the base in a height direction, wherein the resilient body has first and second ends defining a length therebetween, wherein the length is defined in a length direction that is perpendicular to the height direction, and wherein the first end is pivotally coupled to the bracket;

a stop wall that is adjustably fixable relative to the base, wherein the length of the resilient body is caused to increase when the running deck moves towards the base until the second end engages with the stop wall; and an adjustment device coupled to the stop wall, wherein the adjustment device is configured to move the stop wall in the length direction to change the length of the resilient body when the second end thereof engages with the stop wall.

16. The system according to claim 15, wherein the resilient body resists movement of the running deck towards the base in first and second phases, wherein in the second phase the second end of the resilient body is engaged with the stop wall, wherein in the first phase the resistance is provided primarily via bending of the resilient body, wherein in the second phase the resistance is provided primarily via compression of the resilient body, and wherein the stiffness of the resilient body in the first phase is at most 50% of the stiffness in the second phase.

17. The system according to claim 16, wherein the resilient body is a first resilient body and the stop wall is a first stop wall, further comprising additional resilient bodies and additional stop walls functionally equivalent to the first resilient body and the first stop wall, respectively, and wherein the first stop wall and the additional stop walls are moveable together in the length direction to all be simultaneously and equivalently adjusted, further comprising an adjustment frame on which the first stop wall and the additional stop walls are each coupled, and further comprising an actuator that moves the adjustment frame in the length direction such that the first stop wall and the additional stop walls are together adjustable relative to the base.

18. The system according to claim 15, wherein the resilient body is an elastomer having a parabolic shape with a vertex positioned between the first and second ends, wherein the mobile portion is supported at least in part by the vertex of the resilient body.

19. The system according to claim 15, wherein the stop wall is an end of a slot defined within an end stop, wherein the slot extends in the length direction, and wherein the second end of the resilient body is moveable within the slot only in the length direction.

20. A fitness machine providing shock absorption for a user operating the fitness machine, the fitness machine comprising:

a base;

a mobile portion engageable by the user and moveable relative to the base during operation of the fitness machine;

a resilient body that resists movement of the mobile portion towards the base in a height direction, wherein the resilient body has first and second ends defining a length therebetween, and wherein the length is defined in a length direction that is perpendicular to the height direction; and a stop wall engageable by the resilient body, wherein the length of the resilient body increases when the mobile portion moves towards the base until the second end engages with the stop wall;

wherein the resilient body provides shock absorption for the user;

wherein the stop wall is adjustable in the length direction to change the length at which the resilient body engages with the stop wall; and wherein a resistance provided by the resilient body to resist movement of the mobile portion when the resilient body and the stop wall are unengaged is unaffected by adjusting the stop wall in the length direction.

* * * * *